US006382348B1

(12) United States Patent
Chen

(10) Patent No.: US 6,382,348 B1
(45) Date of Patent: May 7, 2002

(54) TWIN MUFFLER

(76) Inventor: Shun-Lai Chen, No. 534-1. Sec. 1, Yuan Shui Rd., Yuanlin Chen, Changhwa Hsien (TW)

( * ) Notice: Subject to any disclaimer, the term of this patent is extended or adjusted under 35 U.S.C. 154(b) by 0 days.

(21) Appl. No.: 09/779,468

(22) Filed: Feb. 9, 2001

(51) Int. Cl.[7] ..... F01N 7/00

(52) U.S. Cl. ..... 181/239; 81/240; 81/232; 81/236

(58) Field of Search ..... 181/240, 232, 181/236, 249, 252, 253, 255, 256, 238, 239, 269, 272

(56) References Cited

U.S. PATENT DOCUMENTS 2,423,574 A * 7/1947 Barrett ..... 60/29
3,957,133 A * 5/1976 Johnson ..... 181/60
4,537,278 A * 8/1985 Okada et al. ..... 181/227
5,902,970 A * 5/1999 Ferri ..... 181/249

* cited by examiner

*Primary Examiner*—Paul Ip
*Assistant Examiner*—Kim Lockett
(74) *Attorney, Agent, or Firm*—Varndell & Varndell, PLLC

(57) ABSTRACT

A twin muffler includes two muffling units connected in parallel to the exhaust post of an engine through a manifold, each muffling unit having a front accumulation chamber, a rear accumulation chamber, a perforated inner tube connected between the front and rear accumulation chambers, the perforated inner tube having a twisted middle section for causing exhaust gas to form a spiral flow, an internally tapered guide tube adapted to guide exhaust air from the perforated inner tube to the rear accumulation chamber, and a hopper-like exhaust endpiece adapted to guide exhaust gas out of the rear accumulation chamber.

2 Claims, 4 Drawing Sheets

TWIN MUFFLER

BACKGROUND AND SUMMARY OF THE INVENTION

The present invention relates to mufflers for motor vehicles and, more particularly, to a twin muffler, which has two muffling units arranged in parallel for softening sound of engine exhaust gas efficiently.

A regular muffler for a motor vehicle exhaust pipe, as shown in FIG. 1 , is generally comprised of a cylindrical casing, a perforated inner tube axially mounted in the cylindrical casing, and a formed material stuffed in the cylindrical casing around the perforated inner tube. This structure of muffler cannot effectively soften sound produced by striking of exhaust gas against the peripheral wall of the cylindrical casing. Further, this structure of muffler gives little help to the improvement of the output torque of the engine.

The invention provides a twin muffler, which eliminates the aforesaid drawbacks. According to one aspect of the present invention, two muffling units are connected in parallel to a manifold adapted to receive engine exhaust gas. Each muffling unit comprises a front accumulation chamber, a rear accumulation chamber, a perforated inner tube connected between the accumulation chambers, a tapered guide tube adapted to guide exhaust gas from the perforated inner tube to the rear accumulation chamber, a foamed material stuffed between the accumulation chambers around the perforated inner tube, and an exhaust endpiece adapted to guide exhaust gas out of the rear accumulation chamber. The perforated inner tube has a twisted middle section, which causes exhaust gas to form a spiral flow. The front accumulation chamber buffers the velocity of intake flow of exhaust gas, so that less noise is produced when exhaust gas passing through each muffling unit.

DETAILED DESCRIPTION OF THE PREFERRED EMBODIMENTS

Figure 1:
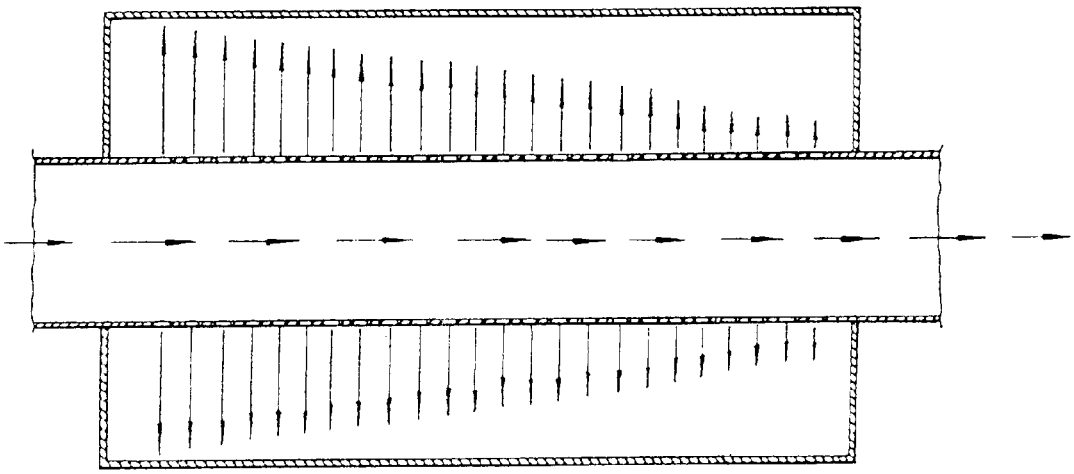
Fig. 1 PRIOR ART
FIG. 1 is a sectional view of a motor vehicle muffler according to the prior art.
Figure 2:
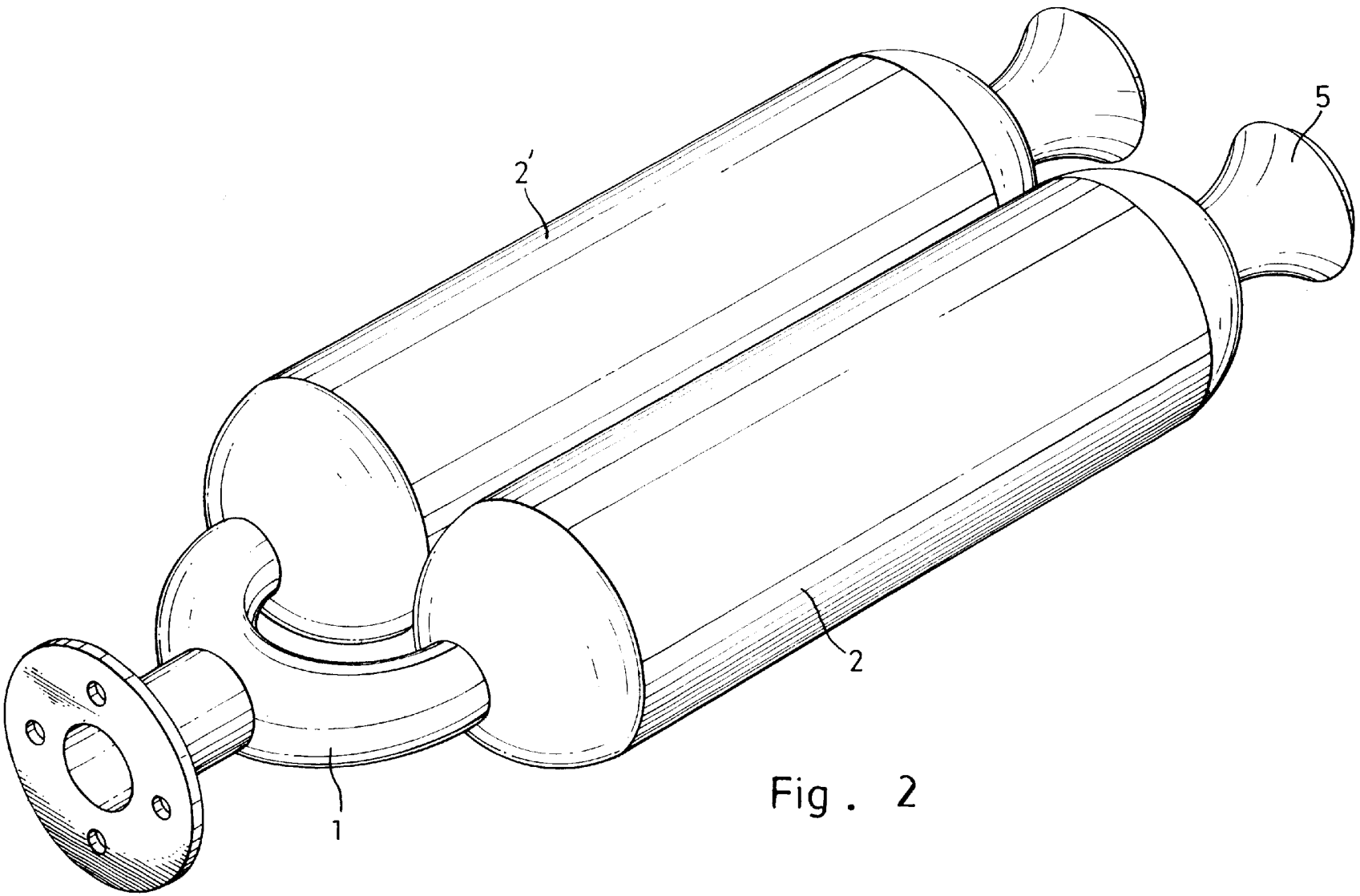
FIG. 2 is an elevational view of a twin muffler according to the present invention.

Referring to FIGS. from 2 through 4, a twin muffler in accordance with the present invention comprises a manifold 1 connected to the exhaust port of the engine (not shown), and two muffling units 2 and 2' connected in parallel to the manifold 1 to soft sound of currents of exhaust gas. Each muffling unit 2 or 2' comprises a front partition board 21, a rear partition board 22, a perforated inner tube 3 connected between the front partition board 21 and the rear partition board 22, an exhaust endpiece 5, and a guide tube 4 connected to one end, namely, the rear end of the perforated inner tube 3.

The partition boards 21 and 22 are shaped like a rounded disk. The front partition board 21 defines with the front end of the respective muffling unit 2 or 2' a front accumulation chamber 7. The rear partition board 22 defines with the rear end of the respective muffling unit 2 or 2' a rear accumulation chamber 8. The guide tube 4 is suspended in the rear accumulation chamber 8, having one end connected to the perforated inner tube 3 and an opposite end spaced from and aimed at the exhaust endpiece 5. The exhaust endpiece 5 is shaped like a hopper fastened to the rear exhaust port of the respective muffling unit 2 or 2', having an inner diameter gradually increased from the front end toward the rear end. The front end of the exhaust endpiece 5 is greater than the inner diameter of the guide tube 4. The perforated inner tube 3 comprises a twisted middle section 31, and a plurality of muffling holes 32 distributed over the periphery except the twisted middle section 31. The guide tube 4 has a tapered front orifice 41 connected to the rear end of the perforated inner tube 3. Further, sound arresting foamed material 6 is stuffed in the space inside the muffling unit 2 or 2' between the partition boards 21 and 22 around the perforated inner tube 3.

Figure 3:
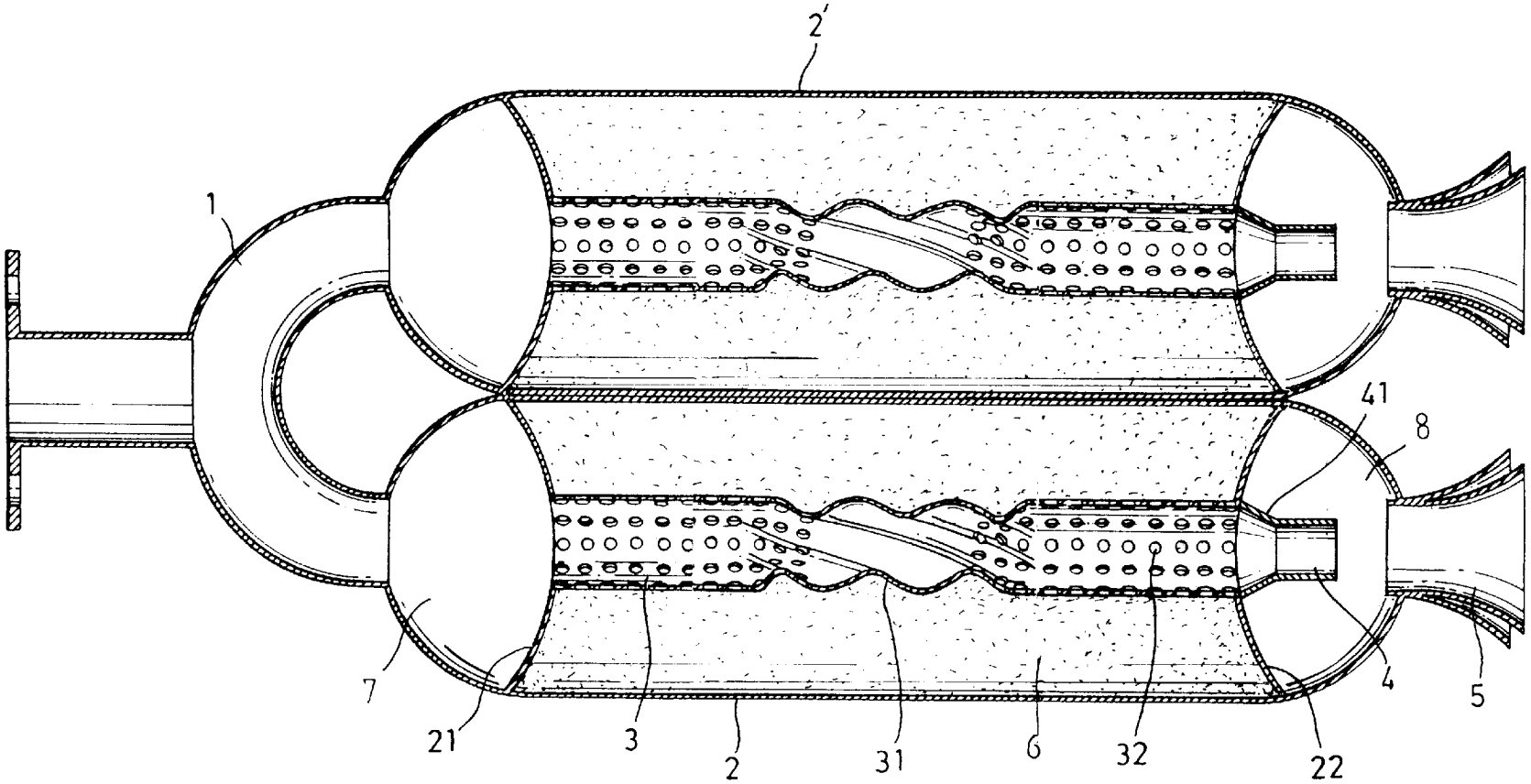
FIG. 3 is a sectional plain view of the twin muffler according to the present invention.
Figure 4:
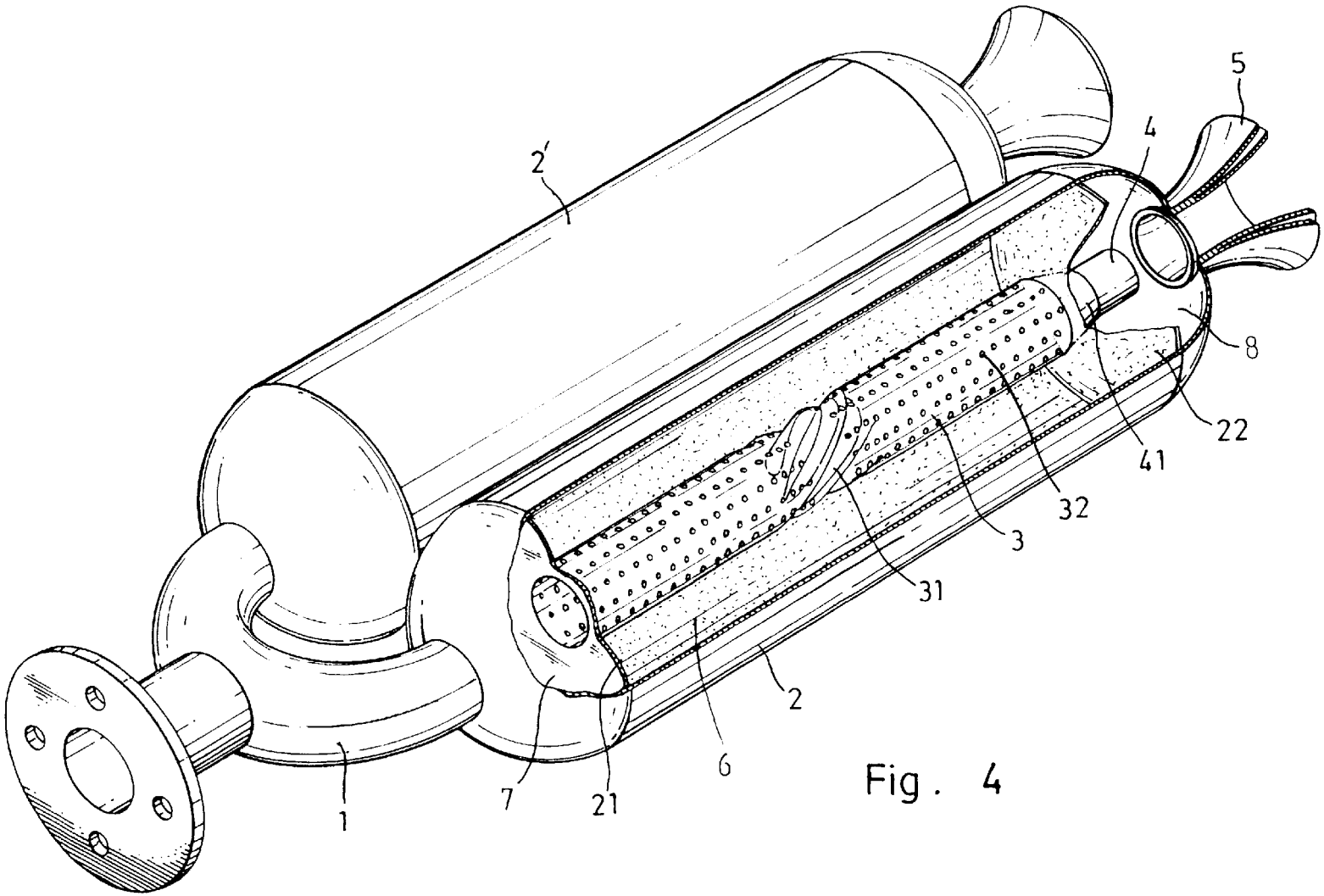
FIG. 4 is a perspective sectional view of twin muffler according to the present invention.

Referring to FIG. 3 again, when exhaust gas passes from the engine into the manifold 1, it is separated into two flows and guided into the two muffling units 2 and 2'. Because exhaust gas of the engine is separated into two flows and guided into the two muffling units 2 and 2', less noise is produced upon striking of exhaust gas against the peripheral wall of each of the muffling units 2 and 2'. When entering the muffling units 2 and 2', exhaust gas is accumulated in the front accumulation chamber 7 to buffer the pressure of the rushing flow of exhaust gas. After the front accumulation chamber 7 has been filled up with exhaust gas, exhaust gas is than forced to flow into the perforated inner tube 3. When passing through the perforated inner tube 3, a small part of exhaust gas escapes out of the perforated inner tube 3 through the muffling holes 32 into open spaces in the foamed material 6, and most exhaust gas passes through the twisted middle section 31 to the exhaust endpiece 5 via the guide tube 4. When passing through the twisted middle section 31, exhaust gas is caused to form a spiral flow, and the velocity of the spiral flow of exhaust gas is accelerated. Because the velocity of the flow of exhaust gas is accelerated when passing through the twisted middle section 31 toward the rear end of the perforated inner tube 3, exhaust gas outside the perforated inner tube 3 is drawn into the perforated inner tube 3 toward the guide tube 4 to fill up the rear accumulation chamber 8, and then to flow out of the rear accumulation chamber 8 through the exhaust endpiece 5. Because exhaust gas is accumulated in the front accumulation chamber 7 before passing through the perforated inner tube 3, incomplete combustion of exhaust gas is burned again in the front combustion chamber 7 under the effect of high temperature inside the muffling units 2 and 2'. Therefore less toxic matter is produced when exhaust gas exhausted through the twin muffler.

While only one embodiment of the present invention has been shown and described, it will be understood that various modifications and changes could be made thereunto without departing from the spirit ands cope of the invention disclosed.

What is claimed is:

1. A twin muffler comprising a manifold adapted to receive exhaust gas from an engine, and two muffling units connected in parallel to said manifold and adapted to soften sound of exhaust gas passing through said manifold, said muffling units each comprising a front partition board defining a front accumulation chamber connected to said manifold to receive exhaust gas, a rear partition board defining a rear accumulation chamber, a rear exhaust port for guiding out exhaust gas accumulated in said rear accumulation chamber, a perforated inner tube connected between said front partition board and said rear partition board for guiding exhaust gas from said front accumulation chamber to said rear accumulation chamber, said perforated inner tube comprising a twisted middle section and a plurality of muffling holes distributed over the periphery thereof beyond said twisted middle section, a guide tube connected to said rear partition board and said perforated inner tube and adapted to guide exhaust gas from said perforated inner tube to said rear accumulation chamber, said guide tube having a diameter gradually reduced from said perforated inner tube toward said rear accumulation chamber, and a formed material stuffed around said perforated inner tube between said front partition board and said rear partition board.

2. The twin muffler of claim 1, wherein said muffling units each further comprise an exhaust endpiece shaped like a hopper, said exhaust endpiece having a front orifice of diameter smaller than said guide tube.

* * * * *